US010453390B2

(12) United States Patent
Zheng

(10) Patent No.: US 10,453,390 B2
(45) Date of Patent: Oct. 22, 2019

(54) PIXEL CIRCUIT AND METHOD FOR DRIVING THE SAME

(71) Applicant: EverDisplay Optronics (Shanghai) Limited, Shanghai (CN)

(72) Inventor: Shi-Song Zheng, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 296 days.

(21) Appl. No.: 15/459,176

(22) Filed: Mar. 15, 2017

(65) Prior Publication Data

US 2018/0033370 A1 Feb. 1, 2018

(30) Foreign Application Priority Data

Jul. 27, 2016 (CN) ..... 2016 1 0600953

(51) Int. Cl.
*G09G 3/3233* (2016.01)

(52) U.S. Cl.
CPC ... *G09G 3/3233* (2013.01); *G09G 2300/0861* (2013.01); *G09G 2310/0251* (2013.01); *G09G 2310/0262* (2013.01); *G09G 2320/0247* (2013.01)

(58) Field of Classification Search
CPC ..... G09G 3/3233; G09G 2300/0861; G09G 2310/0251; G09G 2310/0262; G09G 2320/0247
See application file for complete search history.

(56) References Cited

U.S. PATENT DOCUMENTS

2011/0157126 A1* 6/2011 Chung ..... G09G 3/3233 345/211
2011/0157144 A1* 6/2011 Park ..... G09G 3/3233 345/212
2016/0321991 A1* 11/2016 Song ..... H01L 27/3262
2017/0256200 A1* 9/2017 Duan ..... G09G 3/3233

FOREIGN PATENT DOCUMENTS

CN 102930824 A 2/2013
CN 102930839 A 2/2013
CN 103077680 A 5/2013
CN 103325336 A 9/2013
CN 103676368 A 3/2014
(Continued)

OTHER PUBLICATIONS

The CN1OA dated Mar. 4, 2019 by the CNIPA.

*Primary Examiner* — Amr A Awad
*Assistant Examiner* — Stephen A Bray
(74) *Attorney, Agent, or Firm* — Yunling Ren

(57) ABSTRACT

The present disclosure relates to a pixel circuit and a method for driving the same. The pixel circuit includes: first and second transistors, control terminals of which receive a first scan signal; third and fourth transistors, control terminals of which receive a second scan signal; a fifth transistor, a control terminal of which is electrically coupled to a capacitor; sixth, seventh and eighth transistors, control terminals of which receive a control signal; and a light emitting diode. The present disclosure can reduce or reversely compensate the current leakage, and thus the holding capability of the capacitor can be enhanced. Consequently, the image flicker and thereby the image reliability can be improved.

10 Claims, 13 Drawing Sheets

(56) References Cited

FOREIGN PATENT DOCUMENTS

| | | | |
|---|---|---|---|
| CN | 104575377 | A | 4/2015 |
| CN | 105096826 | A | 11/2015 |
| CN | 105185307 | A | 12/2015 |
| CN | 105185309 | A | 12/2015 |
| CN | 105336293 | A | 2/2016 |
| EP | 1094438 | A1 | 4/2001 |

* cited by examiner

PIXEL CIRCUIT AND METHOD FOR DRIVING THE SAME

CROSS-REFERENCE TO RELATED APPLICATIONS

This application claims priority to Chinese Patent Application No. 201610600953.0, filed on Jul. 27, 2016, the entire contents of which are incorporated herein by reference.

TECHNICAL FIELD

The present disclosure generally relates to display technologies, and more particularly, to a pixel circuit and a method for driving the same.

BACKGROUND

As compared with conventional liquid display panels, Organic Light Emitting Diode (OLED) display panels have advantages such as faster response speed, better color purity and higher brightness, higher contrast ratio and wider view angle, and thus have attracted more attentions from developers of display technologies.

FIG. 1 is a pixel circuit of a conventional light emitting device. The pixel circuit includes: a first transistor T1 having a control terminal electrically coupled to a first scan signal S1 and a first terminal electrically coupled to an input voltage Vint; a second transistor T2 and a third transistor T3, the control terminals of which are electrically coupled to a second scan signal S2; a fourth transistor T4 having a control terminal electrically coupled to a control signal EM; a fifth transistor T5, a control terminal of the fifth transistor T5, a second terminal of the first transistor T1 and a first terminal of the second transistor T2 being electrically coupled to a node B together; a sixth transistor T6 having a control terminal electrically coupled to a control signal EM; a capacitor Cst having a first terminal electrically coupled to a first power voltage ELVDD and a second terminal electrically coupled to the control terminal of the fifth transistor T5. A first terminal of a light emitting diode such as an OLED and a second terminal of the sixth transistor T6 are electrically coupled to a node A, and a second terminal of the light emitting diode D is electrically coupled to a second power voltage ELVSS.

When the first scan signal S1 and the second scan signal S2 are at a high level VGH and the control signal EM is at a low level VGL, the fourth transistor T4 to the sixth transistor T6 are turned on, the first transistor T1 to the third transistor T3 are turned off, and the OLED emits light. At this time, there exist two current leakage paths in the circuit: in the first current leakage path, the current flows to the input voltage Vint via the first transistor T1 (the first path is referred to as a Vint current leakage path), and in the second current leakage path, the current flows to the light emitting diode via the second transistor T2 and the sixth transistor T6 (the second path is referred to as an Anode current leakage path). The two current leakage paths cause reduction in the capacitance value of the capacitor Cst, thereby resulting in decreased holding capability of the Cst and potential reduction across the Cst. Consequently, the gate voltage drop of the fifth transistor T5 becomes larger. As the capacitance value is reduced, the holding capability of the capacitor Cst becomes weaker, and this can result in worse image flicker under a low frequency (typically, lower than 60 Hz), and thus the reliability of displayed images can be influenced.

At present, in order to reduce the image flicker, adjustments have been made from both design and process aspects to increase the capacitance value and thereby to enhance the reliability of images. However, by doing this, new problems occur: if design rules are violated or the adjustments in design are too aggressive, symmetry and matching state of other devices may be influenced; also, as the thickness of the sandwiched capacitor dielectric is reduced, the process becomes more difficult, and new problems with the structures of other relevant layers may arise.

Thus, there is a need for a new pixel circuit and a method for driving the same.

It should be noted that, information disclosed in the above background portion is provided only for better understanding of the background of the present disclosure, and thus it may contain information that does not form the prior art known by those of ordinary skill in the art.

SUMMARY

Aiming at whole or a part of the problems in conventional technologies, embodiments of the present disclosure provide a pixel circuit and a method for driving the same, which are capable of increasing the holding capability of the capacitor and improving the image reliability under a low frequency operation.

According to an aspect of embodiments of the present disclosure, there is provided a pixel circuit, including: a first transistor having a first terminal electrically coupled to an input voltage; a second transistor having a first terminal electrically coupled to a second terminal of the first transistor, wherein a control terminal of the first transistor and a control terminal of the second transistor are electrically coupled to a first scan signal; a third transistor having a first terminal electrically coupled to a data signal; a fourth transistor having a first terminal electrically coupled to a second terminal of the second transistor, wherein a control terminal of the third transistor and a control terminal of the fourth transistor are electrically coupled to a second scan signal; a fifth transistor having a first terminal electrically coupled to a second terminal of the third transistor, a second terminal electrically coupled to a second terminal of the fourth transistor, and a control terminal electrically coupled to the second terminal of the second transistor and the first terminal of the fourth transistor; a sixth transistor having a first terminal electrically coupled to a first power voltage, and a second terminal electrically coupled to the second terminal of the third transistor and the first terminal of the fifth transistor; a seventh transistor having a first terminal electrically coupled to the second terminal of the fourth transistor and the second terminal of the fifth transistor, and a second terminal electrically coupled to a first terminal of a light emitting diode; an eighth transistor having a first terminal electrically coupled to the first power voltage, a second terminal electrically coupled to the second terminal of the first transistor and the first terminal of the second transistor, wherein a control terminal of the sixth transistor, a control terminal of the seventh transistor and a control terminal of the eighth transistor are electrically coupled to a control signal; and a capacitor having a first terminal electrically coupled to the first power voltage, and a second terminal electrically coupled to the control terminal of the fifth transistor.

In an exemplary embodiment of the present disclosure, the light emitting diode has a second terminal electrically coupled to a second power voltage.

In an exemplary embodiment of the present disclosure, the pixel circuit further includes a ninth transistor having a first terminal electrically coupled to the second terminal of the fourth transistor and the second terminal of the eighth transistor, a second terminal electrically coupled to the second terminal of the fifth transistor, and a control terminal electrically coupled to the second scan signal.

In an exemplary embodiment of the present disclosure, the pixel circuit further includes: a tenth transistor having a first terminal electrically coupled to the second terminal of the seventh transistor, a second terminal electrically coupled to the input voltage, and a control terminal electrically coupled to a third scan signal.

According to another aspect of embodiments of the present disclosure, there is provided a pixel circuit, including: a first transistor having a first terminal electrically coupled to an input voltage, and a control terminal electrically coupled to a first scan signal; a second transistor having a first terminal electrically coupled to a second terminal of the first transistor; a third transistor having a first terminal electrically coupled to a data signal; a fourth transistor having a first terminal electrically coupled to a second terminal of the second transistor, wherein a control terminal of the second transistor and a control terminal of the fourth transistor are electrically coupled to a second scan signal; a fifth transistor having a first terminal electrically coupled to a second terminal of the third transistor, a second terminal electrically coupled to a second terminal of the fourth transistor, and a control terminal electrically coupled to the second terminal of the first transistor and the first terminal of the second transistor; a sixth transistor having a first terminal electrically coupled to a first power voltage, a second terminal electrically coupled to the second terminal of the third transistor and the first terminal of the fifth transistor; a seventh transistor having a first terminal electrically coupled to the second terminal of the fourth transistor and the second terminal of the fifth transistor, and a second terminal electrically coupled to a first terminal of a light emitting diode; an eighth transistor having a first terminal electrically coupled to the first power voltage, and a second terminal electrically coupled to the second terminal of the second transistor and the first terminal of the fourth transistor, wherein a control terminal of the sixth transistor, a control terminal of the seventh transistor and a control terminal of the eighth transistor are electrically coupled to a control signal; and a capacitor having a first terminal electrically coupled to the first power voltage, and a second terminal electrically coupled to the control terminal of the fifth transistor.

In an exemplary embodiment of the present disclosure, the light emitting diode has a second terminal electrically coupled to a second power voltage.

In an exemplary embodiment of the present disclosure, the pixel circuit further includes: a ninth transistor having a first terminal electrically coupled to the second terminal of the seventh transistor, a second terminal electrically coupled to the input voltage, and a control terminal electrically coupled to a third scan signal.

According to another aspect of embodiments of the present disclosure, there is provided a pixel circuit, including: a first transistor configured to receive an input voltage; a second transistor electrically coupled to the first transistor, wherein the first transistor and the second transistor are controlled by a first scan signal; a third transistor configured to receive a data signal; a fourth transistor electrically coupled to the second transistor, wherein the third transistor and the fourth transistor are controlled by a second scan signal; a fifth transistor electrically coupled to the third transistor and the fourth transistor and having a control terminal electrically coupled to the second transistor and the fourth transistor; a sixth transistor configured to receive a first power voltage and electrically coupled to the third transistor and the fifth transistor; a seventh transistor electrically coupled to the fourth transistor, the fifth transistor and a light emitting diode; an eighth transistor configured to receive the first power voltage and electrically coupled to the first transistor and the second transistor, wherein the sixth transistor, the seventh transistor and the eighth transistor are controlled by a control signal; and a capacitor electrically coupled to the first power voltage and the fifth transistor.

In an exemplary embodiment of the present disclosure, the pixel circuit further includes: a ninth transistor that is electrically coupled to the fourth transistor, the eighth transistor and the fifth transistor, and is controlled by the second scan signal.

In an exemplary embodiment of the present disclosure, the pixel circuit further includes: a tenth transistor that receives the input voltage, is electrically coupled to the seventh transistor and is controlled by a third scan signal.

According to another aspect of embodiment of the present disclosure, there is provided a method for driving the pixel circuit, wherein the pixel circuit is operated under a reset phase, a compensation phase and a display phase, and the method includes: in the reset phase, turning on the first transistor and the second transistor by the first scan signal, turning off the third to eighth transistors by the second scan signal and the control signal, and writing the input voltage into the control terminal of the fifth transistor; in the compensation phase, turning on the third to fifth transistors by the second scan signal, turning off the first transistor, the second transistor, the sixth transistor, the seventh transistor and the eighth transistor by the first scan signal and the control signal, and inputting the data signal into the fifth transistor via the third transistor; and in the display phase, turning on the fifth to eighth transistors by the control signal, and turning off the first to fourth transistors by the first scan signal and the second scan signal.

In an exemplary embodiment of the present disclosure, the pixel circuit further includes a ninth transistor having a first terminal electrically coupled to the second terminal of the fourth transistor and the second terminal of the eighth transistor, a second terminal electrically coupled to the second terminal of the fifth transistor, and a control terminal electrically coupled to the second scan signal;

and the method further includes:

in the reset phase, turning off the ninth transistor by the second scan signal;

in the compensation phase, turning on the ninth transistor by the second scan signal; and in the display phase, turning off the ninth transistor by the second scan signal.

According to another aspect of embodiments of the present disclosure, there is provided a method for driving the pixel circuit, wherein the pixel circuit is operated under a reset phase, a compensation phase and a display phase;

and the method includes:

in the reset phase, turning on the first transistor by the first scan signal, turning off the second to eighth transistors by the second scan signal and the control signal, and writing the input voltage into the control terminal of the fifth transistor;

in the compensation phase, turning on the second to fifth transistors by the second scan signal, turning off the first transistor, the sixth transistor, the seventh transistor and the eighth transistor by the first scan signal and the control signal, and inputting the data signal into the fifth transistor via the third transistor; and in the display phase, turning on the fifth to eighth transistors by the control signal, and turning off the first to fourth transistors by the first scan signal and the second scan signal.

By the pixel circuit and the method for driving the pixel circuit provided by embodiments of the present disclosure, the current leakage can be reduced or reversely compensated, and thus the holding capability of the capacitor can be increased. Consequently, the image flicker can be reduced and thereby the reliability of displayed images can be improved.

It should be appreciated that the above general description and the detailed description hereinafter are exemplary and illustrative only, which do not limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure. It will be obvious that the drawings in the following description are some exemplary embodiments of the present disclosure only, and those ordinary skilled in the art may obtain other drawings form these drawings.

FIG. 3-1(*a*) illustratively shows operation principles when a pixel circuit according to an exemplary embodiment is operated in a reset phase.

FIG. 3-1(*b*) is a chart illustratively showing driving time sequences (or driving timing) when a pixel circuit according to an exemplary embodiment is operated in the reset phase.

FIG. 3-2(*a*) illustratively shows operation principles when a pixel circuit according to an exemplary embodiment is operated in a compensation phase.

FIG. 3-2(*b*) is a chart illustratively showing driving timing when a pixel circuit according to an exemplary embodiment is operated in the compensation phase.

FIG. 3-3(*a*) illustratively shows operation principles when a pixel circuit according to an exemplary embodiment is operated in a display phase.

FIG. 3-3(*b*) is a chart illustratively showing driving timing when a pixel circuit according to an exemplary embodiment is operated in the display phase.

DETAILED DESCRIPTION

In order to make the technical problems to be solved by the present disclosure, the technical solutions employed by the present disclosure, and the technical effects which can be arrived at by the present disclosure become clearer, embodiments of the present disclosure will be described in detail below with reference to drawings. It should be appreciated that the described embodiments are only a part of the embodiments of the present disclosure instead all of them, and those of ordinary skill in this art can obtain other embodiments, which fall into the scope as claimed by the present invention, based on the embodiments described herein.

The features, structures or characteristics described herein may be combined in one or more embodiments in any suitable manner. In the following descriptions, many specific details are provided to facilitate sufficient understanding of the embodiments of the present disclosure. However, one of ordinary skills in this art will appreciate that the technical solutions in the present disclosure may be practiced without one or more of the specific details, or by employing other methods, modules, devices, steps and so on. In other conditions, well-known modules, methods, devices, implementations, steps or operations are not shown or described in detail so as to avoid confusion of respective aspects of the present disclosure.

The technical solutions of the present disclosure will be described with reference to drawings and specific implementations.

Figure 2:
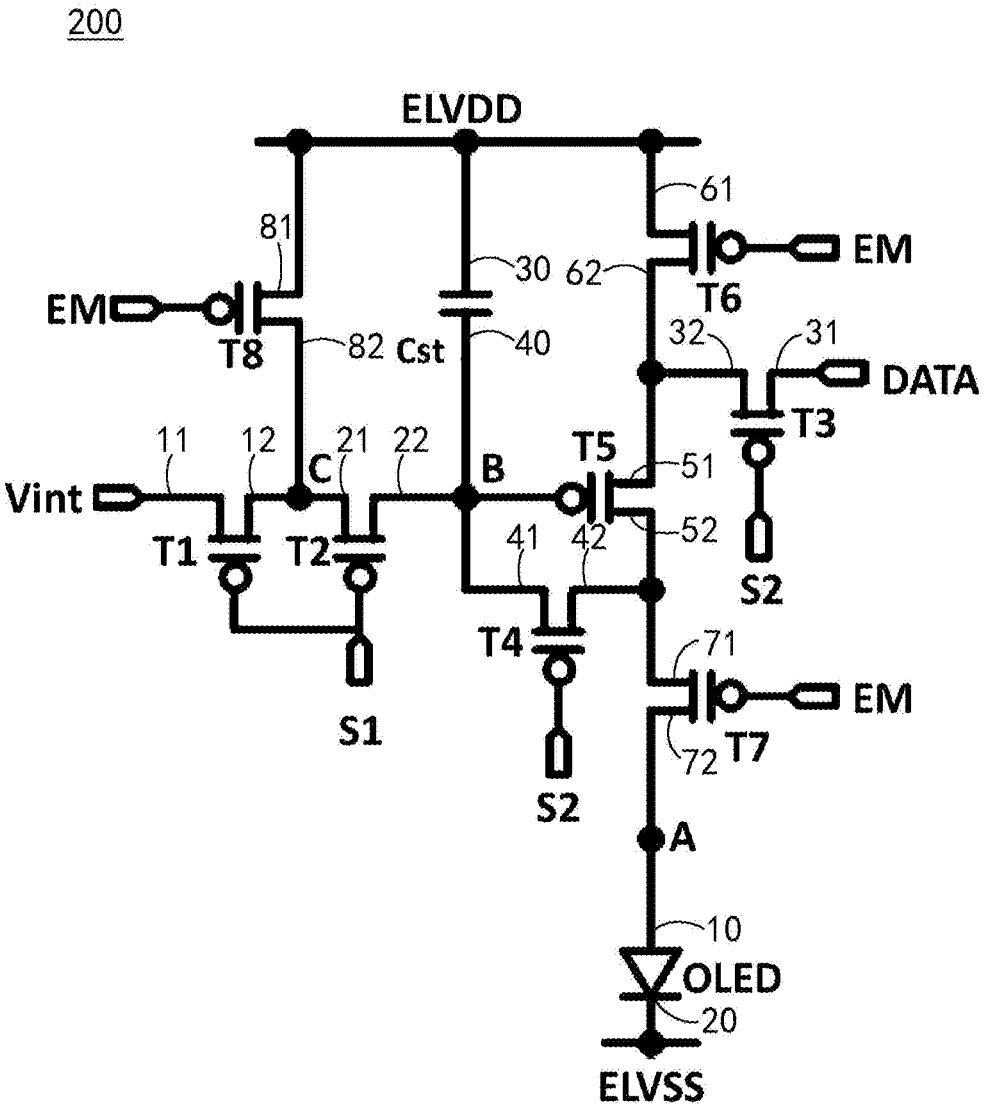
FIG. 2 is a schematic diagram illustratively showing a pixel circuit according to an exemplary embodiment of the present disclosure.

FIG. 2 is a schematic diagram illustratively showing a pixel circuit according to an exemplary embodiment of the present disclosure. In the embodiment, the pixel circuit 200 includes a first transistor T1, a second transistor T2, a third transistor T3, a fourth transistor T4, a fifth transistor T5, a sixth transistor T6, a seventh transistor T7, an eighth transistor T8 and a capacitor Cst. A first terminal 11 of the first transistor T1 is electrically coupled to an input voltage Vint. A first terminal 21 of the second transistor T2 is electrically coupled to a second terminal 12 of the first transistor T1, and a control terminal of the first transistor T1 and a control terminal of the second transistor T2 are electrically coupled to a first scan signal S 1. A first terminal 31 of the third transistor T3 is electrically coupled to a data signal DATA. A first terminal 41 of the fourth transistor T4 is electrically coupled to a second terminal 22 of the second transistor T2, and a control terminal of the third transistor T3 and a control terminal of the fourth transistor T4 are electrically coupled to a second scan signal S2. A first terminal 51 of the fifth transistor T5 is electrically coupled to a second terminal 32 of the third transistor T3, a second terminal 52 of the fifth transistor T5 is electrically coupled to a second terminal 42 of the fourth transistor T4, and a control terminal of the fifth transistor T5 is electrically coupled to the second terminal 22 of the second transistor T2 and the first terminal 41 of the fourth transistor T4. A first terminal 61 of the sixth transistor T6 is electrically coupled to a first power voltage ELVDD, and a second terminal 62 of the sixth transistor T6 is electrically coupled to the second terminal 32 of the third transistor T3 and the first terminal 51 of the fifth transistor T5. A first terminal 71 of the seventh transistor T7 is electrically coupled to the second terminal 42 of the fourth transistor T4 and the second terminal 52 of the fifth transistor T5, and a second terminal 72 of the seventh transistor T7 and a first terminal 10 (for example, an anode) of a light emitting diode D are electrically connected to a node A ($A_{node}$). A first terminal 81 of the eighth transistor T8 is electrically coupled to the first power voltage ELVDD, a second terminal 82 of the eighth transistor T8, the second terminal 12 of the first transistor T1, and the first terminal 21 of the second transistor T2 are electrically coupled to a node C ($C_{node}$) together, a control terminal of the sixth transistor T6, a control terminal of the seventh transistor T7 and a control terminal of the eighth transistor T8 are electrically coupled to a control signal EM. A first terminal 30 of the capacitor Cst is electrically coupled to the first power voltage ELVDD, and a second terminal 40 of the capacitor Cst, the control terminal of the fifth transistor T5 and the second terminal 22 of the second transistor T2 are electrically coupled to a node B ($B_{node}$) together.

In an exemplary embodiment, a second terminal 20 (for example, a cathode) of the light emitting diode D is electrically coupled to a second power voltage ELVSS. In an embodiment, the first power voltage ELVDD is a positive power voltage, and the second power voltage ELVSS is a negative power voltage. For example, ELVDD can be about 5V, for example, 4.6V, and ELVSS can be −2.4V, and embodiments of the present disclosure do not impose specific limitations on this.

In an exemplary embodiment, the input voltage Vint can be a negative voltage, for example, −3V, and the present disclosure is not limited to this. The input voltage Vint can be smaller than the second power voltage ELVSS.

In an exemplary embodiment, the light emitting diode D can be an OLED or an Active Matrix Organic Light Emitting Diode (AMOLED).

In an exemplary embodiment, the first to eighth transistors T1 to T8 can be field effect transistors, or bipolar transistors, and the present disclosure does not impose specific limitations on the type of the transistors. In the exemplary embodiments below, for example, the transistors are P type MOSFET (Metal Oxide Semiconductor Field Effect Transistor). It should be noted that the high and low levels for turning on and off the transistors are described with the example where the transistors are P type MOSFET, and if the type of the transistors is changed according to specific design requirements, the high and low levels for turning on and off the transistors can be changed accordingly.

The pixel circuit in embodiments of the present disclosure can work under a low frequency, i.e., the operation frequency of the pixel circuit is lower than 60 Hz, for example, the lowest operation frequency can be 5 Hz.

Figure 1:
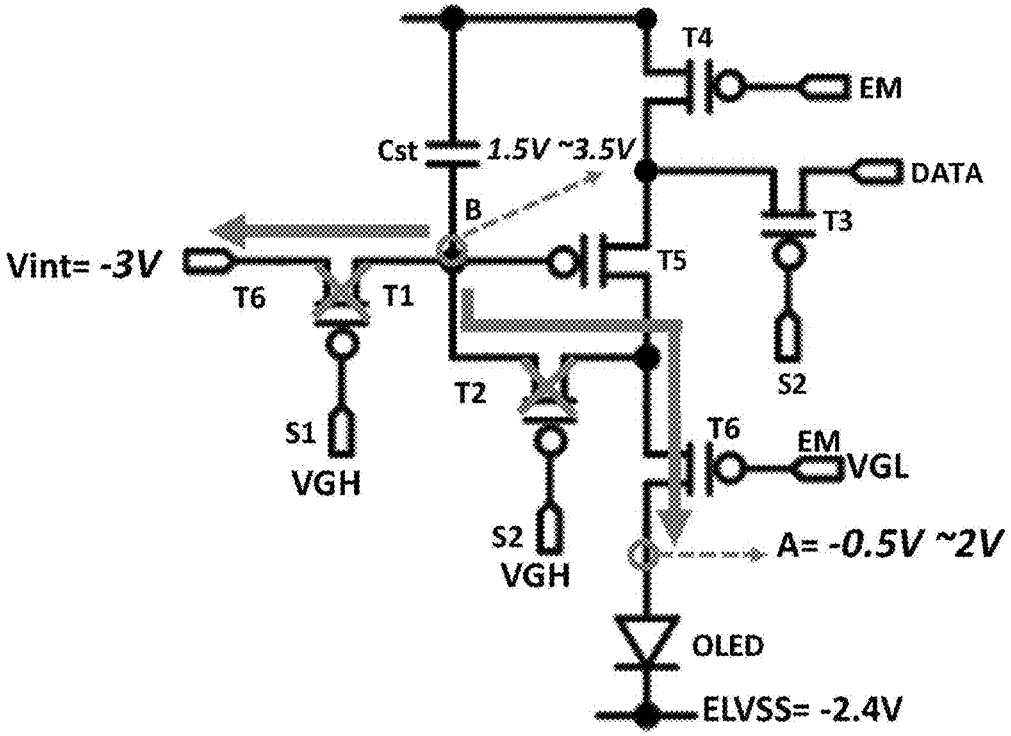
FIG. 1 is a schematic diagram illustratively showing a pixel circuit of a conventional light emitting device.
Figures 1, 3:
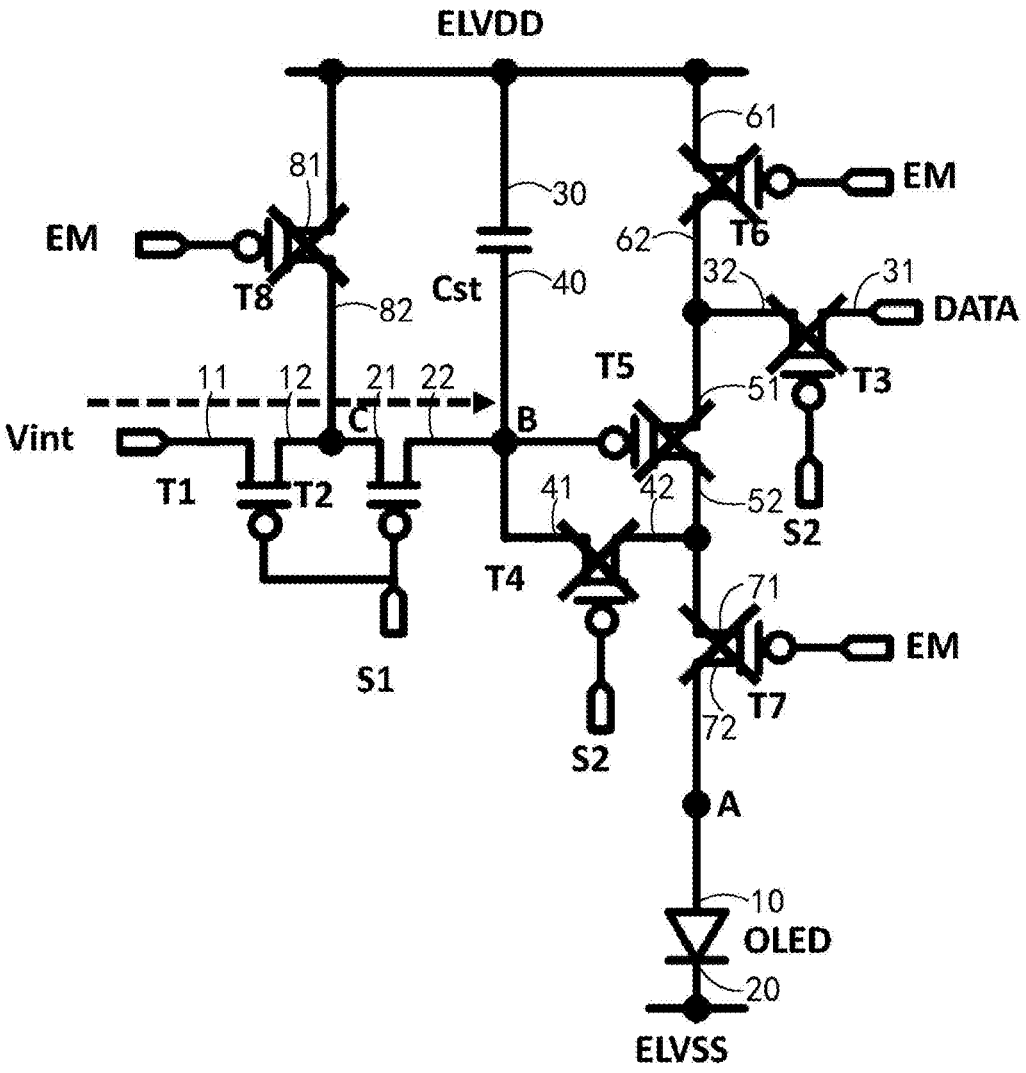
Figures 1, 3:
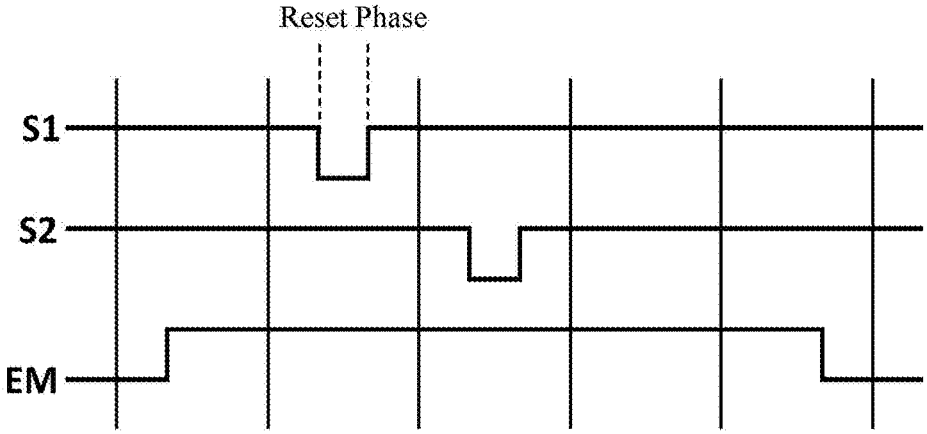
Figures 2, 3:
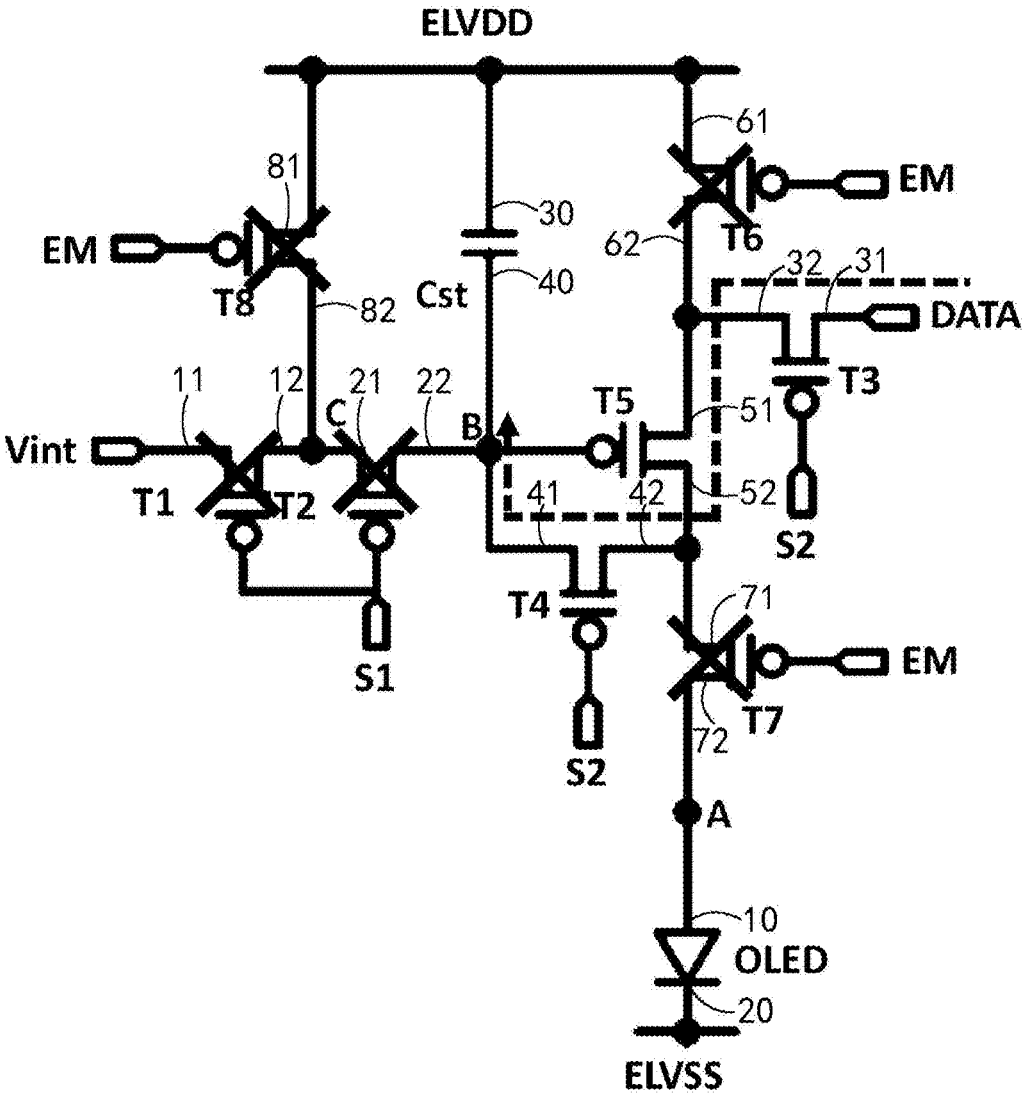
Figures 2, 3:
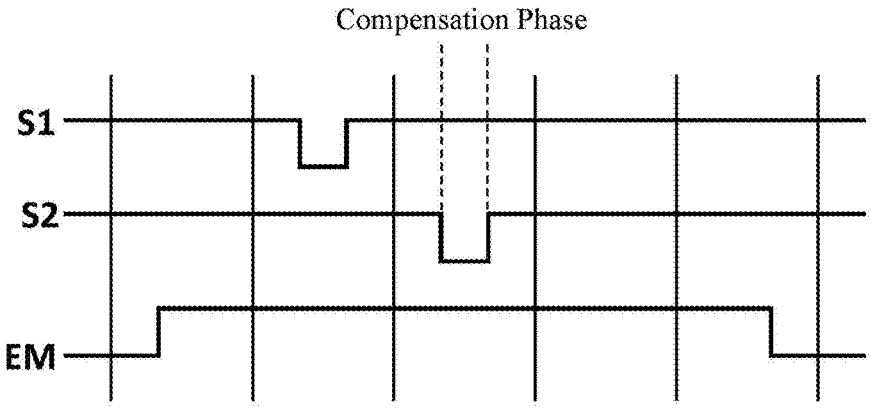
Figure 3:
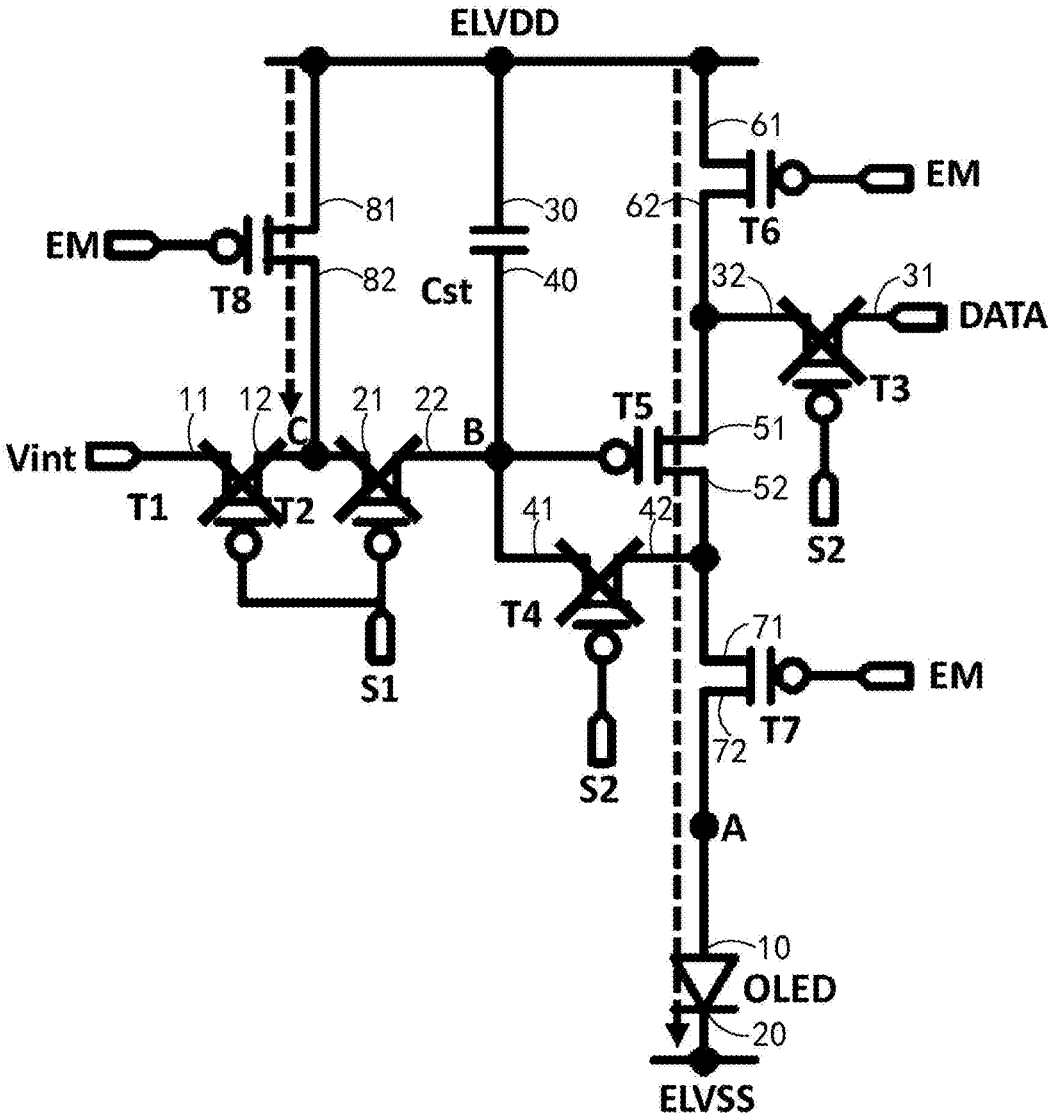
Figure 3:
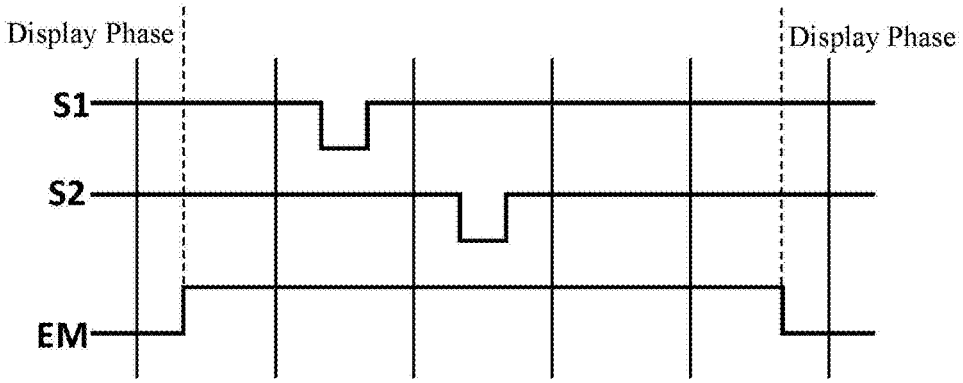

FIGS. 3-1(*a*), 3-1(*b*), 3-2(*a*), 3-2(*b*), 3-3(*a*) and 3-3(*d*) are charts showing driving timing of the pixel circuit shown in FIG. 2. As shown in these drawings, the driving method can include a reset phase, a compensation phase, and a display phase.

As shown in FIGS. 3-1(*a*) and 3-1(*b*), in the reset phase (Phase 1), the first scan signal S1 is at a low level, the second scan signal S2 and the control signal EM are at a high level. At this time, the first transistor T1 and the second transistor T2 are turned on, the third to eighth transistors T3 to T8 are turned off, the input voltage Vint is written into the control terminal (for example, the gate) of the fifth transistor T5, and the state of the fifth transistor T5 is reset so that the potential difference $V_{SG}$ between the source (i.e., the first terminal 51) and the gate (i.e., the control terminal) of the fifth transistor T5 is larger than an on threshold Vth, which means the subsequent operations can be performed.

As shown in FIGS. 3-2(*a*) and 3-2(*b*), in the compensation phase (Phase2), the first scan signal S1 and the control signal EM are at a high level, and the second scan signal S2 is at a low level. At this time, the third to fifth transistors T3 to T5 are turned on, the first transistor T1, the second transistor T2, the sixth transistor T6, the seventh transistor T7 and the eighth transistor T8 are turned off, the data signal DATA is input to the fifth transistor T5 via the third transistor T3, a voltage $V_{SG}$ (having a value of Vth) across the source and the gate of the fifth transistor T5 occurs, the voltage $V_{SD}$ between the source and the drain of the fifth transistor T5 is equal to zero, and at this time the fifth transistor T5 enters into a saturation region, so that $V_{SG}$=Vth, and the data signal DATA is written.

As shown in FIGS. 3-3(*a*) and 3-3(*b*), in the display phase (Phase3), the first scan signal S1 and the second scan signal S2 are at a high level, and the control signal EM is at a low level. At this time, the fifth to eighth transistors T5 to T8 are turned on, the first to fourth transistors T1 to T4 are turned off, and the current from the fifth transistor T5 flows through the light emitting diode D to make the light emitting diode D emit light; meanwhile, because the eighth transistor T8 is turned on, the voltage at the node C where the first transistor T1 and the second transistor T2 are coupled together becomes the first power voltage ELVDD (for example, about 5V), the input voltage Vint is about −3V, the voltage at the node B (i.e., the voltage at the gate of the fifth transistor T5) is about 1.5 to3.5V, the voltage at the node A is about −0.5V to 2V, and the eighth transistor T8 can reduce the voltage $V_{SD}$ between the drain and the source of the second transistor T2, and thus the current leakage along the first current leakage path from the gate $V_G$ of the fifth transistor T5 to the input voltage Vint can be prevented. Consequently, the holding capability of the capacitor Cst can be effectively improved.

The first scan signal S1 in the above FIGS. 3-1(*a*), 3-1(*b*), 3-2(*a*), 3-2(*b*), 3-3(*a*) and 3-3(*b*) is used for resetting the potential of the previous data signal DATA in the capacitor Cst, and the low level VGL of the first scan signal S1 can be set at the time when the control signal EM is at a high level VGH and meanwhile needs to be before the low level VGL of the second scan signal S2. The second scan signal S2 is used for writing the potential of the data signal DATA of the current gray level in the capacitor Cst, and the low level VGL of the second scan signal S2 can be set at the time when the control signal EM is at a high level VGH and meanwhile needs to be after the low level VGL of the first scan signal S1. The control signal EM serves to block the current signal of the light emitting diode, i.e., stop the current from flowing through the light emitting diode, so as to make the circuit work reliably. When the control signal EM is at a high level VGH, the internal functions of the circuit (i.e., all other operations than the light emission of the light emitting diode) are on; when the control signal EM is at a low level VGL, the input power makes the light emitting diode emit light. In the drawings, the ratio between the duration of the high level VGH and the duration of the low level VGL is adjustable, and the principle is that the time when the control signal EM is at a high level VGH can enable operations carried out by means of the first and second scan signals S1 to S2 (operations controlled by the first and second signals S1 to S2), and when the control signal EM is at a low level VGL, the light emitting diode is turned on, and the operations of the first and second scan signals S1 and S2 may be influenced.

In the pixel circuit and the method for driving the same provided by embodiments of the present disclosure, by adjusting the circuit structure, for example, adding some transistors to compensate the current in the current leakage path(s), the holding capability of the capacitor is improved, the potential shift of the capacitor due to the current leakage can be suppressed, and thus the reliability of image display under a low frequency operation can be improved.

Figure 4:
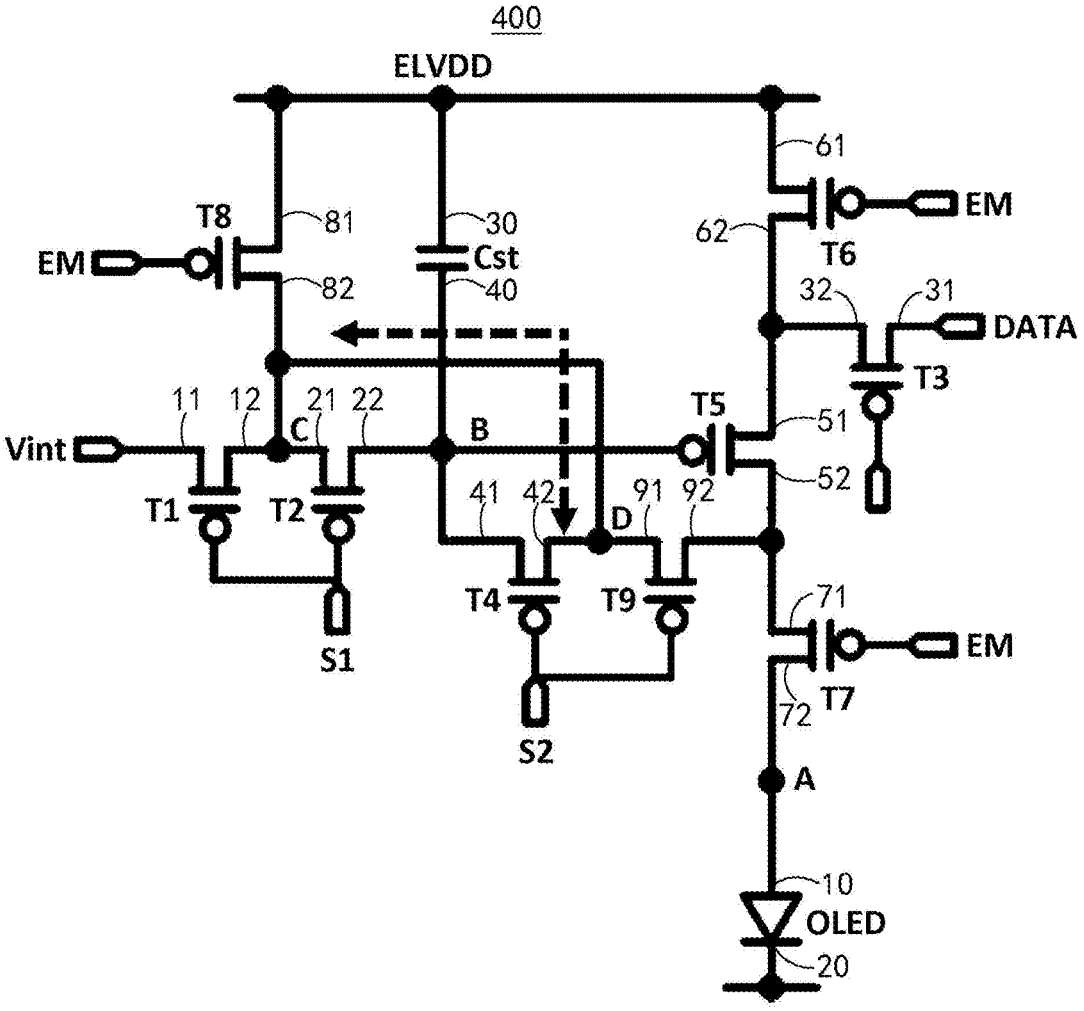
FIG. 4 is a schematic diagram illustratively showing a pixel circuit according to an exemplary embodiment of the present disclosure.

FIG. 4 is a schematic diagram of a pixel circuit 400 according to an exemplary embodiment of the present disclosure. The difference between the pixel circuit 400 in the present embodiment and the pixel circuit 200 in the above described embodiment resides in that the pixel circuit 400 further includes a ninth transistor T9, a first terminal 91 of the ninth transistor T9 is electrically coupled to the second terminal 42 of the fourth transistor T4 and the second terminal 82 of the eighth transistor T8, a second terminal 92 of the ninth transistor T9 is electrically coupled to the second terminal 52 of the fifth transistor T5, and a control terminal of the ninth transistor T9 is electrically coupled to the second scan signal S2.

Referring to the timing chart in FIG. 3 which can be used for driving the pixel circuit as shown in FIG. 4, in the reset phase, the first scan signal S1 is at a low level, the second scan signal S2 and the control signal EM are at a high level; at this time, the first transistor T1 and the second transistor T2 are turned on, the third to ninth transistors T3 to T9 are turned off, the input voltage Vint is written into the gate of the fifth transistor T5, and the voltage is stored in the capacitor Cst.

In the compensation phase, the first scan signal S1 and the control signal EM are at a high level, and the second scan signal S2 is at a low level; at this time, the third to fifth transistors T3 to T5 and the ninth transistor T9 are turned on, the first transistor T1, the second transistor T2 and the sixth to eighth transistors T6 to T8 are turned off, the data signal DATA is input to the fifth transistor T5 via the third transistor T3, a voltage Vth across the source and the gate of the fifth transistor T5 occurs, and the potential at the gate of the fifth transistor T5 (i.e., the potential of the capacitor Cst) is Vint-Vth at this time.

In the display phase, the first scan signal S1 and the second scan signal S2 are at a high level, and the control signal EM is at a low level; at this time, the fifth to eighth transistors T5 to T8 are turned on, the first to fourth transistors T1 to T4 and the ninth transistor T9 are turned off, the current of the fifth transistor T5 flows through the light emitting diode D to make the light emitting diode D emit light; meanwhile, because the eighth transistor T8 is turned on, the voltage at the node C where the first transistor T1 and the second transistor T2 are coupled together is the first power voltage ELVDD, and at this time the voltage $V_{SD}$ across the drain and the source of the second transistor T2 and the voltage across the drain and the source of the ninth transistor T9 are reduced, and thereby the current leakage along the first current leakage path from the gate of the fifth transistor T5 to the input voltage Vint and the current leakage along the second current leakage path from the gate of the fifth transistor T5 to the light emitting diode are reduced.

Figure 5:
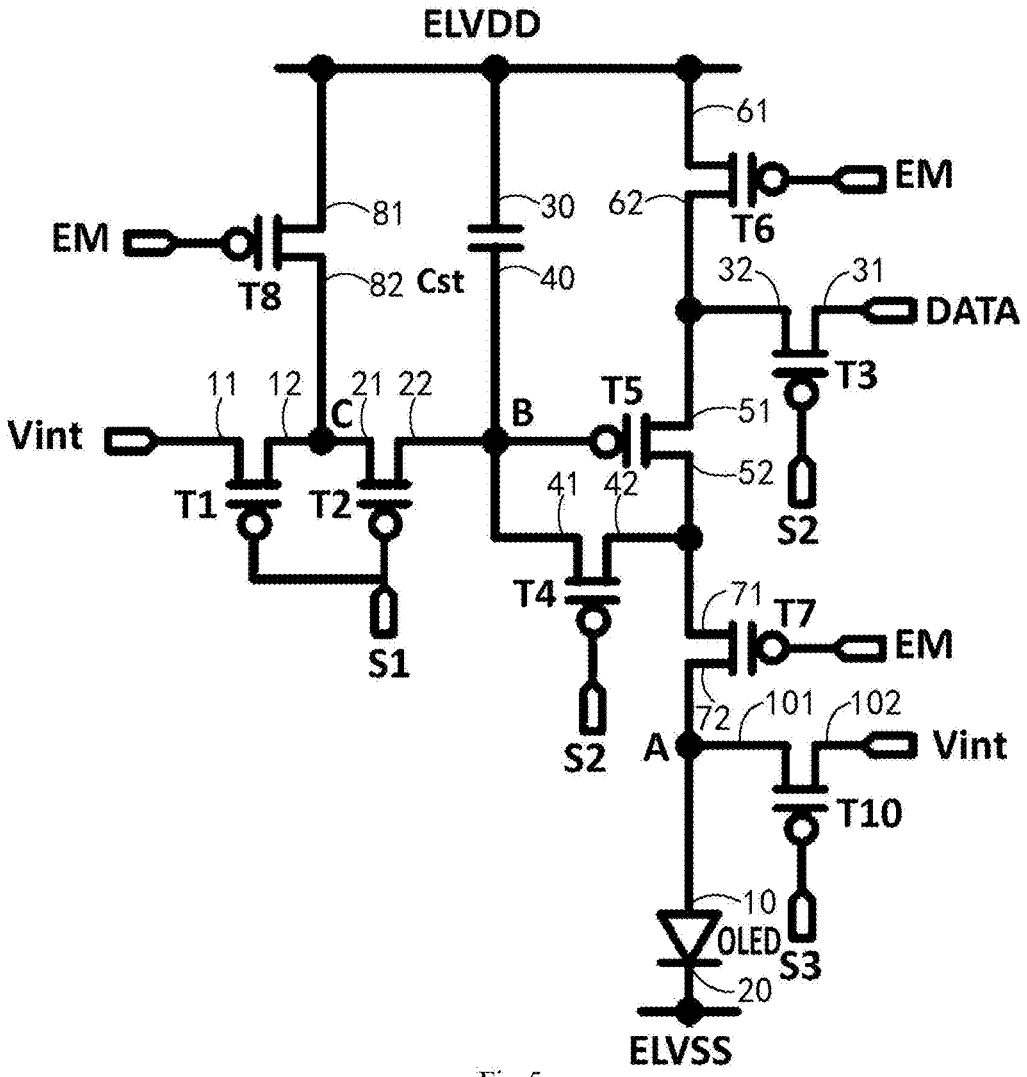
FIG. 5 is a schematic diagram illustratively showing a pixel circuit according to an exemplary embodiment of the present disclosure.

FIG. 5 is a schematic diagram of a pixel circuit 500 according to an exemplary embodiment of the present disclosure. The difference between the pixel circuit 500 in the present embodiment and the pixel circuit 200 in the above described embodiment resides in that the pixel circuit 500 further includes a tenth transistor T10, a first terminal 101 of the tenth transistor T10 is electrically coupled to the second terminal 72 of the seventh transistor T7, a second terminal 102 of the tenth transistor T10 is electrically coupled to the input voltage Vint, and a control terminal of the tenth transistor T10 is electrically coupled to a third scan signal S3. The tenth transistor T10 can function to reset the light emitting diode (for example, OLED).

Figure 6:
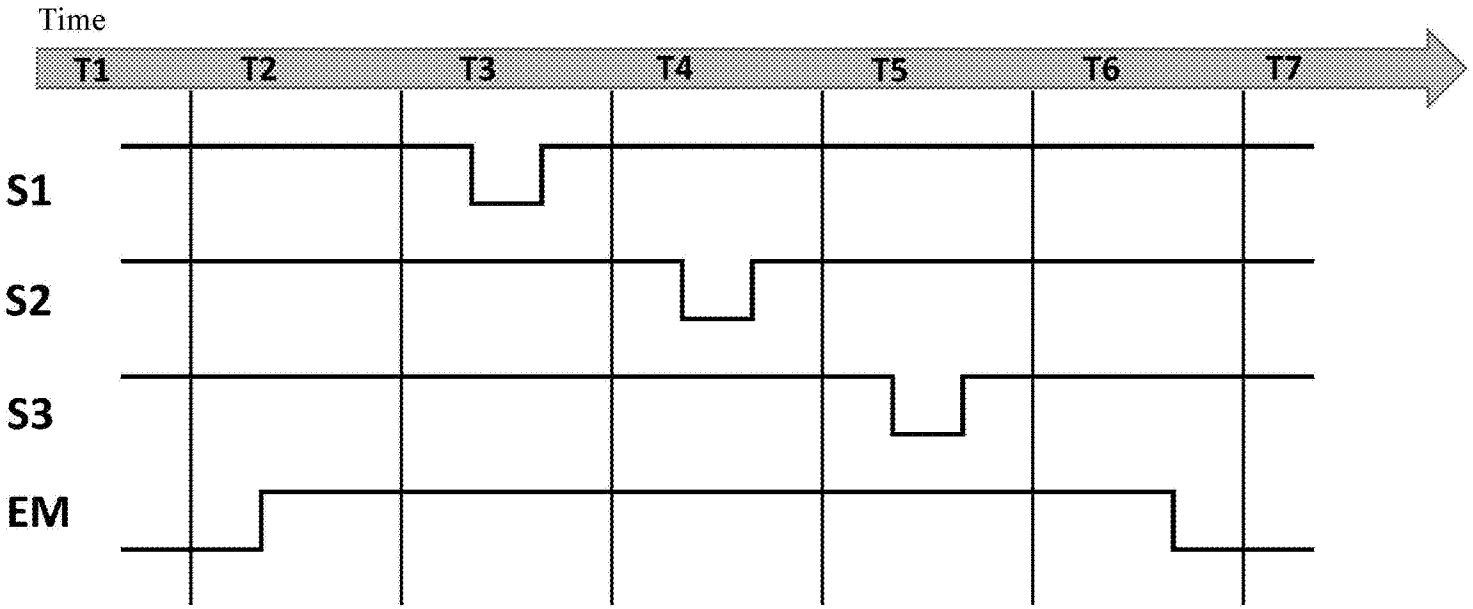
FIG. 6 is a chart illustratively showing the driving timing of the pixel circuit according to an exemplary embodiment of the present disclosure.

Referring to the timing chart in FIG. 6 which can be used for driving the pixel circuit shown in FIG. 5, because of the addition of the third scan signal S3, a release phase is added into the operation procedure of the circuit.

In the reset phase, the first scan signal S1 is at a low level, the second scan signal S2, the third scan signal S3 and the control signal EM are at a high level; at this time, the first transistor T1 and the second transistor T2 are turned on, the third to eighth transistors T3 to T8 and the tenth transistor T10 are turned off, the input voltage Vint is written into the gate of the fifth transistor T5, and the voltage is stored in the capacitor Cst.

In the compensation phase, the first scan signal S1, the third scan signal S3 and the control signal EM are at a high level, and the second scan signal S2 is at a low level; at this time, the third to fifth transistors T3 to T5 are turned on, the first transistor T1, the second transistor T2, the sixth to eighth transistors T6 to T8 and the tenth transistor T10 are turned off, the data signal DATA is input to the fifth transistor T5 via the third transistor T3, a voltage Vth across the source and the gate of the fifth transistor T5 occurs, and at this time the potential at the gate of the fifth transistor T5 (i.e., the potential at the capacitor Cst) is Vint-Vth.

In the release phase, the first scan signal S1, the second scan signal S2 and the control signal EM are at a high level, and the third scan signal S3 is at a low level; at this time, the tenth transistor T10 is turned on, the first to eighth transistors T1 to T8 are turned off, the input voltage Vint is input to the light emitting diode D via the tenth transistor T10; because the input Vint is −3V at this time for example, the second power voltage ELVSS is −2.4V for example, if the input voltage Vint is smaller than or equal to the second power source ELVSS, the input voltage Vint is input to the first terminal 10 of the OLED, the potential of the OLED during the previous light emitting period is released so that the resetting of the light emitting diode can be realized. The third scan signal S3 can be changed during the time period when the control signal EM is at a high level VGH.

In the display phase, the first scan signal S1, the second scan signal S2 and the third scan signal S3 are at a high level, and the control signal EM is at a low level; at this time, the fifth to eighth transistors T5 to T8 are turned on, the first to fourth transistors T1 to T4 and the tenth transistor T10 are turned off, the current from the fifth transistor T5 flows through the light emitting diode D to make the light emitting diode D emit light; meanwhile, because the eighth transistor T8 is turned on, the voltage at the node C where the first transistor T1 and the second transistor T2 are coupled together is the first power voltage ELVDD, and at this time the voltage $V_{SD}$ across the drain and the source of the second transistor T2 is reduced, and thereby the current leakage from the gate of the fifth transistor T5 to the input voltage Vint is reduced.

The time sequences of the first scan signal S1 and the second scan signal S2 and their operation principles are the same as the above embodiments described in connection with FIG. 3, and thus repeated descriptions are omitted here. In the schematic diagram of FIG. 6, the low level VGL of the first scan signal S1 can fall within the time period T3 or T4, and the low level VGL of the second scan signal S2 can fall within the time period T4 or T5. The third scan signal S3 is used for resetting the potential of the previous data signal DATA in the light emitting diode, and the low level VGL of the third scan signal S3 can be set at the time when the control signal EM is at a high level VGH. In FIG. 6, the low level VGL of the third scan signal S3 can fall within the time period T3 or T4 or T5. As shown, the ratio of the duration of the high level VGH and the duration of the low level VGL is adjustable, and the principle is that the time when the control signal EM is at a high level VGH can enable operations carried out by means of the first to third scan signals S1 to S3 (in other words, the operations controlled by the first to third signals S1 to S3 can be done within the time period when the control signal EM is at a high level VGH).

Figure 7:
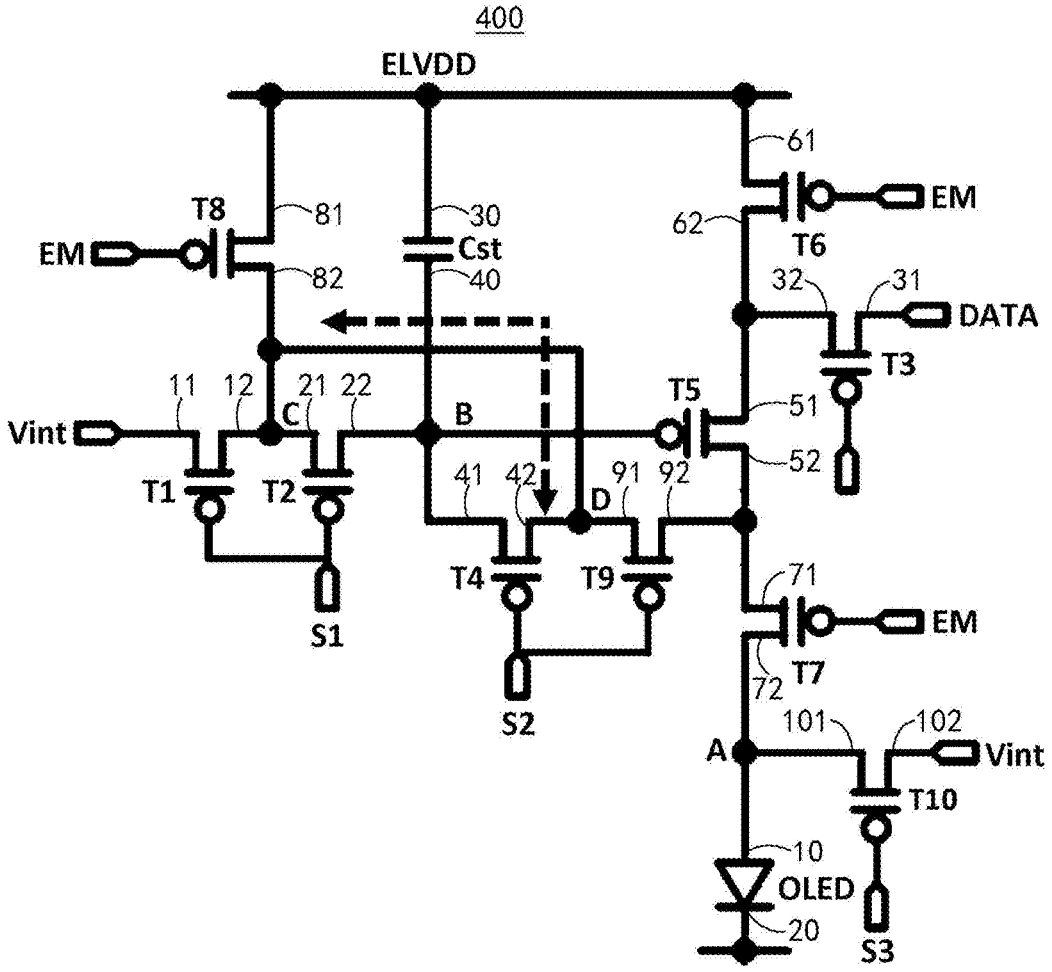
FIG. 7 is a schematic diagram illustratively showing a pixel circuit according to an exemplary embodiment of the present disclosure.

FIG. 7 is a schematic diagram of a pixel circuit 700 according to an exemplary embodiment of the present disclosure. The difference between the pixel circuit 700 in the present embodiment and the pixel circuit 400 in the above described embodiment resides in that the pixel circuit 700 further includes a tenth transistor T10, a first terminal 101 of the tenth transistor T10 is electrically coupled to the second terminal 72 of the seventh transistor T7, a second terminal 102 of the tenth transistor T10 is electrically coupled to the input voltage Vint, and a control terminal of the tenth transistor T10 is electrically coupled to a third scan signal S3.

Referring to the timing chart in FIG. 6 which can be used for driving the pixel circuit shown in FIG. 7, because of the addition of the third scan signal S3, a release phase is added into the operation procedure of the circuit.

In the reset phase, the first scan signal S1 is at a low level, the second scan signal S2, the third scan signal S3 and the control signal EM are at a high level; at this time, the first transistor T1 and the second transistor T2 are turned on, the third to tenth transistors T3 to T10 are turned off, the input voltage Vint is written into the gate of the fifth transistor T5.

In the compensation phase, the first scan signal S1, the third scan signal S3 and the control signal EM are at a high level, and the second scan signal S2 is at a low level; at this time, the third to fifth transistors T3 to T5 and the ninth transistor T9 are turned on, the first transistor T1, the second transistor T2, the sixth to eighth transistors T6 to T8 and the tenth transistor T10 are turned off, the data signal DATA is input to the fifth transistor T5 via the third transistor T3, a voltage Vth across the source and the gate of the fifth transistor T5 occurs.

In the release phase, the first scan signal S1, the second scan signal S2 and the control signal EM are at a high level, and the third scan signal S3 is at a low level; at this time, the tenth transistor T10 is turned on, the first to ninth transistors T1 to T9 are turned off, the input voltage Vint is input to the light emitting diode D to release the potential during the previous light emission time period.

In the display phase, the first scan signal S1, the second scan signal S2 and the third scan signal S3 are at a high level, and the control signal EM is at a low level; at this time, the fifth to eighth transistors T5 to T8 are turned on, the first to fourth transistors T1 to T4, the ninth transistor T9 and the tenth transistor T10 are turned off, the current from the fifth transistor T5 flows through the light emitting diode D to make the light emitting diode D emit light; meanwhile, because the eighth transistor T8 is turned on, the voltage at the node C where the first transistor T1 and the second transistor T2 are coupled together is the first power voltage ELVDD, and at this time the voltage across the drain and the source of the second transistor T2 and the voltage across the drain and the source of the ninth transistor T9 are reduced, and thereby the current leakage along the paths from the gate of the fifth transistor T5 to the input voltage Vint and from the gate of the fifth transistor T5 to the light emitting diode can be reduced.

Figure 8:
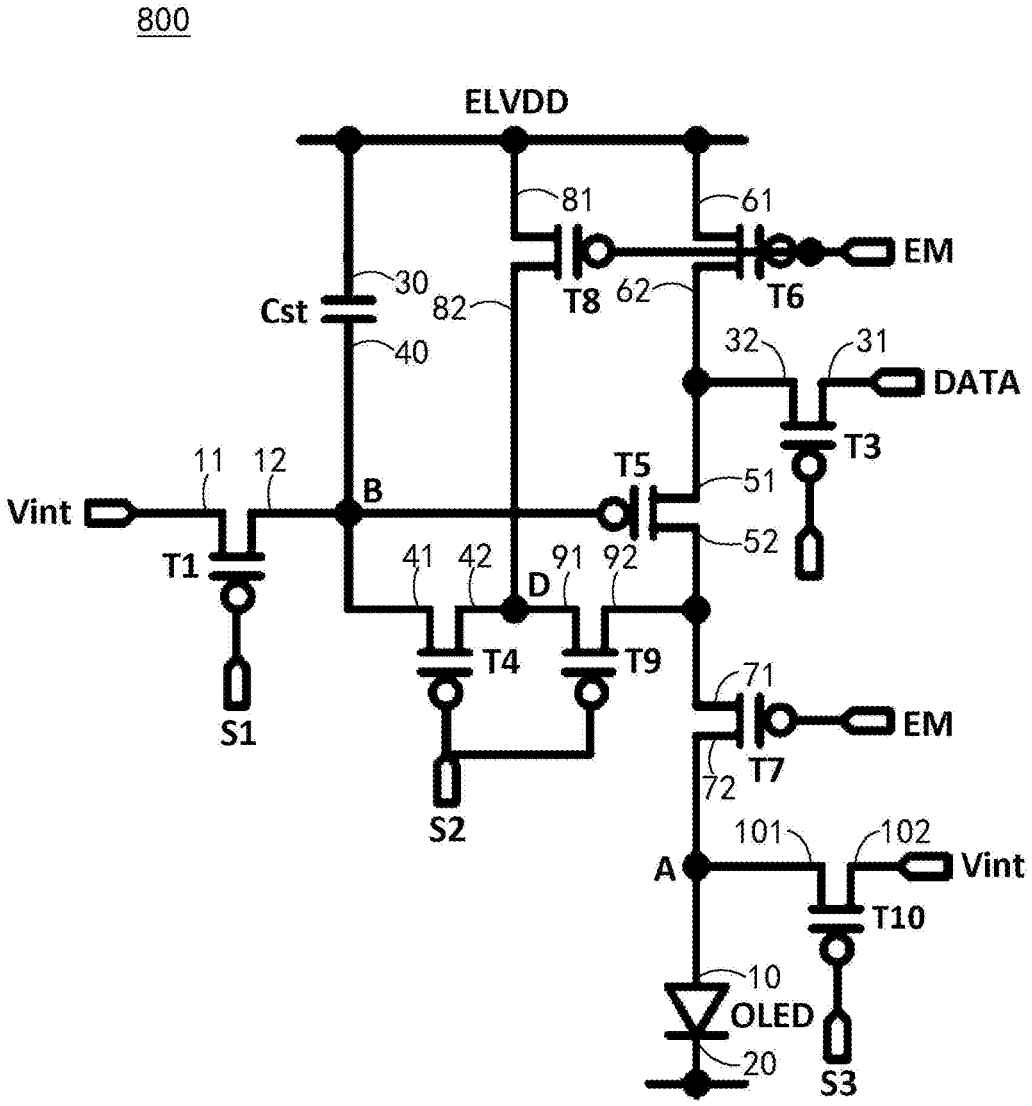
FIG. 8 is a schematic diagram illustratively showing a pixel circuit according to an exemplary embodiment of the present disclosure.

FIG. 8 is a schematic diagram of a pixel circuit 800 according to an exemplary embodiment of the present disclosure. In the present embodiment, the pixel circuit 800 includes a first transistor T1, a second transistor T4, a third transistor T3, a fourth transistor T9, a fifth transistor T5, a sixth transistor T6, a seventh transistor T7, an eighth transistor T8 and a capacitor Cst. A first terminal 11 of the first transistor T1 is electrically coupled to an input voltage Vint, and a control terminal of the first transistor T1 is electrically coupled to the first scan signal S1. A first terminal 41 of the second transistor T4 is electrically coupled to a second terminal 12 of the first transistor T1. A first terminal 31 of the third transistor T3 is electrically coupled to a data signal DATA. A first terminal 91 of the fourth transistor T9 is electrically coupled to a second terminal 42 of the second transistor T4, and a control terminal of the second transistor T4 and a control terminal of the fourth transistor T9 are electrically coupled to a second scan signal S2. A first terminal 51 of the fifth transistor T5 is electrically coupled to a second terminal 32 of the third transistor T3, a second terminal 52 of the fifth transistor T5 is electrically coupled to a second terminal 92 of the fourth transistor T9, and a control terminal of the fifth transistor T5, the second terminal 12 of the first transistor T1 and the first terminal 41 of the second transistor T4 are electrically coupled to a node B ($B_{node}$) together. A first terminal 61 of the sixth transistor T6 is electrically coupled to a first power voltage ELVDD, and a second terminal 62 of the sixth transistor T6 is electrically coupled to the second terminal 32 of the third transistor T3 and the first terminal 51 of the fifth transistor T5. A first terminal 71 of the seventh transistor T7 is electrically coupled to the second terminal 92 of the fourth transistor T9 and the second terminal 52 of the fifth transistor T5, and a second terminal 72 of the seventh transistor T7 is electrically coupled to a first terminal 10 of a light emitting diode D. A first terminal 81 of the eighth transistor T8 is electrically coupled to the first power voltage ELVDD, a second terminal 82 of the eighth transistor T8, the second terminal 42 of the second transistor T4, and the first terminal 91 of the fourth transistor T9 are electrically coupled to a node D ($D_{node}$) together, a control terminal of the sixth transistor T6, a control terminal of the seventh transistor T7 and a control terminal of the eighth transistor T8 are electrically coupled to a control signal EM. A first terminal 30 of the capacitor Cst is electrically coupled to the first power voltage ELVDD, and a second terminal 40 of the capacitor Cst is electrically coupled to the node B.

Referring to the timing chart in FIG. 3 which can be used for driving the pixel circuit as shown in FIG. 8, in the reset phase, the first scan signal S1 is at a low level, the second scan signal S2 and the control signal EM are at a high level; at this time, the first transistor T1 is tuned on, the second transistor T4, the third transistor T3, the fourth transistor T9, and the fifth to eighth transistors T5 to T8 are turned off, the input voltage Vint is written into the gate of the fifth transistor T5.

In the compensation phase, the first scan signal S1 and the control signal EM are at a high level, and the second scan signal S2 is at a low level; at this time, the second transistor T4, the third transistor T3, the fourth transistor T9 and the fifth transistor T5 are turned on, the first transistor T1, and the sixth to eighth transistors T6 to T8 are turned off, the data signal DATA is input to the fifth transistor T5 via the third transistor T3, a voltage Vth across the source and the gate of the fifth transistor T5 occurs.

In the display phase, the first scan signal S1 and the second scan signal S2 are at a high level, and the control signal EM is at a low level; at this time, the fifth to eighth transistors T5 to T8 are turned on, the first transistor T1, the second transistor T4, the third transistor T3 and the fourth transistor T9 are turned off, the current of the fifth transistor T5 flows through the light emitting diode D to make the light emitting diode D emit light; meanwhile, because the eighth transistor T8 is turned on, the voltage at the node D where the second transistor T4 and the fourth transistor T9 are coupled together is the first power voltage ELVDD, and at this time the voltage across the drain and the source of the fourth transistor T9 is reduced, and thereby the current leakage from the gate of the fifth transistor T5 to the light emitting diode via the second transistor T4 and the fourth transistor T9 can be reduced.

In an exemplary embodiment, referring to FIG. 8 again, the pixel circuit further includes a ninth transistor T10, a first terminal 101 of the ninth transistor T10 is electrically coupled to the second terminal 72 of the seventh transistor T7, a second terminal 102 of the ninth transistor T10 is electrically coupled to the input voltage Vint, and a control terminal of the ninth transistor T10 is electrically coupled to a third scan signal S3. The timing for driving the pixel circuit can be found in the descriptions in connection with FIG. 6 and repeated descriptions will be omitted here.

In view of the above, in the pixel circuit and the method for driving the pixel circuit provided by embodiments of the present disclosure, by adjusting the circuit structure to compensate the holding capability of the capacitor Cst, and thus the voltages across devices in the current leakage paths can be improved, the current leakage level can be reduced and even the current leakage can be reversely compensated. Consequently, the present disclosure can solve the problem of worse flicker under low frequency operations in conventional technologies due to reduction of holding capability of the capacitor Cst caused by the reduction in the capacitance value.

It should be appreciated that the drawings are provided only for illustrating some exemplary embodiments of the present disclosure and not necessarily drawn to scale. The same reference signs throughout drawings denote the same or similar part, and repeated descriptions thereof will be omitted.

In addition, although the steps of the method according to the present disclosure are illustrated in particular orders in the drawings, this does not require or indicate that these steps are necessarily performed according to the specific order, or all the steps have to be performed in order to arrive at expected results. Additionally or alternatively, some steps may be omitted, some steps may be integrated into one step, and/or one step may be divided into a plurality of steps.

Other implementations of the present disclosure are obvious to those skilled in the art after reading the present specification and implementing the technical solution disclosed in the present disclosure. The present disclosure also covers any modification, usage, or adaptive changes within the general concept of the present disclosure or involving general knowledge or common technical means that are not disclosed in the present disclosure. The specification and embodiments are illustrative only, and the protection scope and spirit of the present disclose is defined in the appended claims.

It should be understood that the present disclosure is not limited to the exact structures which are shown in drawings and described above, some modifications and changes can be made without departing the scope of the present disclosure. The scope of the present disclosure should be defined by the appended claims.

What is claimed is:

1. A pixel circuit, comprising:

a first transistor configured to receive an input voltage, wherein a first terminal of the first transistor receives the input voltage;

a second transistor electrically coupled to the first transistor, wherein the first transistor and the second transistor are controlled by a first scan signal, and a first terminal of the second transistor and a second terminal of the first transistor are directly connected to a node;

a third transistor configured to receive a data signal;

a fourth transistor electrically coupled to the second transistor, wherein the third transistor and the fourth transistor are controlled by a second scan signal;

a fifth transistor electrically coupled to the third transistor and the fourth transistor and having a control terminal electrically coupled to the second transistor and the fourth transistor;

a sixth transistor directly electrically coupled to a first power voltage and electrically coupled to the third transistor and the fifth transistor;

a seventh transistor electrically coupled to the fourth transistor, the fifth transistor and a light emitting diode;

an eighth transistor directly electrically coupled to the first power voltage and directly electrically coupled to the node, wherein the sixth transistor, the seventh transistor and the eighth transistor are controlled by a control signal; and a capacitor electrically coupled to the first power voltage and the fifth transistor.

2. The pixel circuit according to claim 1, wherein the light emitting diode has a second terminal electrically coupled to a second power voltage.

3. The pixel circuit according to claim 1, further comprising:

a ninth transistor electrically coupled to the fourth transistor, the eighth transistor and the fifth transistor, and controlled by the second scan signal.

4. The pixel circuit according to claim 1, further comprising:

a tenth transistor configured to receive the input voltage, and electrically coupled to the seventh transistor and controlled by a third scan signal.

5. A pixel circuit, comprising:

a first transistor having a first terminal electrically coupled to an input voltage, and a control terminal electrically coupled to a first scan signal;

a second transistor having a first terminal electrically coupled to a second terminal of the first transistor;

a third transistor having a first terminal electrically coupled to a data signal;

a fourth transistor having a first terminal electrically coupled to a second terminal of the second transistor, wherein a control terminal of the second transistor and a control terminal of the fourth transistor are electrically coupled to a second scan signal, and the second terminal of the second transistor and the first terminal of the fourth transistor are directly connected to a node;

a fifth transistor having a first terminal electrically coupled to a second terminal of the third transistor, a second terminal electrically coupled to a second terminal of the fourth transistor, and a control terminal electrically coupled to the second terminal of the first transistor and the first terminal of the second transistor;

a sixth transistor having a first terminal directly electrically coupled to a first power voltage, a second terminal electrically coupled to the second terminal of the third transistor and the first terminal of the fifth transistor;

a seventh transistor having a first terminal electrically coupled to the second terminal of the fourth transistor and the second terminal of the fifth transistor, and a second terminal electrically coupled to a first terminal of a light emitting diode;

an eighth transistor having a first terminal directly electrically coupled to the first power voltage, and a second terminal directly electrically coupled to the node, wherein a control terminal of the sixth transistor, a control terminal of the seventh transistor and a control terminal of the eighth transistor are electrically coupled to a control signal; and a capacitor having a first terminal electrically coupled to the first power voltage, and a second terminal electrically coupled to the control terminal of the fifth transistor.

6. The pixel circuit according to claim 5, wherein the light emitting diode has a second terminal electrically coupled to a second power voltage.

7. The pixel circuit according to claim 5, further comprising:

a ninth transistor having a first terminal electrically coupled to the second terminal of the seventh transistor, a second terminal electrically coupled to the input voltage, and a control terminal electrically coupled to a third scan signal.

8. A method for driving a pixel circuit, wherein the pixel circuit comprises:

a first transistor configured to receive an input voltage, wherein a first terminal of the first transistor receives the input voltage;

a second transistor electrically coupled to the first transistor, wherein the first transistor and the second transistor are controlled by a first scan signal, and a first terminal of the second transistor and a second terminal of the first transistor are directly connected to a node;

a third transistor configured to receive a data signal;

a fourth transistor electrically coupled to the second transistor, wherein the third transistor and the fourth transistor are controlled by a second scan signal;

a fifth transistor electrically coupled to the third transistor and the fourth transistor and having a control terminal electrically coupled to the second transistor and the fourth transistor;

a sixth transistor directly electrically coupled to a first power voltage and electrically coupled to the third transistor and the fifth transistor;

a seventh transistor electrically coupled to the fourth transistor, the fifth transistor and a light emitting diode;

an eighth transistor directly electrically coupled to the first power voltage and directly electrically coupled to the node, wherein the sixth transistor, the seventh transistor and the eighth transistor are controlled by a control signal; and a capacitor electrically coupled to the first power voltage and the fifth transistor;

wherein the pixel circuit is operated under a reset phase, a compensation phase and a display phase, and the method comprises:

in the reset phase, turning on the first transistor and the second transistor by the first scan signal, turning off the third to eighth transistors by the second scan signal and the control signal, and writing the input voltage into the control terminal of the fifth transistor;

in the compensation phase, turning on the third to fifth transistors by the second scan signal, turning off the first transistor, the second transistor, the sixth transistor, the seventh transistor and the eighth transistor by the first scan signal and the control signal, and inputting the data signal into the fifth transistor via the third transistor; and in the display phase, turning on the fifth to eighth transistors by the control signal, and turning off the first to fourth transistors by the first scan signal and the second scan signal.

9. The driving method according to claim 8, wherein the pixel circuit further comprises:

a ninth transistor electrically coupled to the fourth transistor, the eighth transistor and the fifth transistor, and controlled by the second scan signal;

wherein the method further comprises:

in the reset phase, turning off the ninth transistor by the second scan signal;

in the compensation phase, turning on the ninth transistor by the second scan signal; and in the display phase, turning off the ninth transistor by the second scan signal.

10. A method for driving a pixel circuit, wherein the pixel circuit comprises:

a first transistor having a first terminal electrically coupled to an input voltage, and a control terminal electrically coupled to a first scan signal;

a second transistor having a first terminal electrically coupled to a second terminal of the first transistor;

a third transistor having a first terminal electrically coupled to a data signal;

a fourth transistor having a first terminal electrically coupled to a second terminal of the second transistor, wherein a control terminal of the second transistor and a control terminal of the fourth transistor are electrically coupled to a second scan signal, and the second terminal of the second transistor and the first terminal of the fourth transistor is directly connected to a node;

a fifth transistor having a first terminal electrically coupled to a second terminal of the third transistor, a second terminal electrically coupled to a second terminal of the fourth transistor, and a control terminal electrically coupled to the second terminal of the first transistor and the first terminal of the second transistor;

a sixth transistor having a first terminal directly electrically coupled to a first power voltage, a second terminal electrically coupled to the second terminal of the third transistor and the first terminal of the fifth transistor;

a seventh transistor having a first terminal electrically coupled to the second terminal of the fourth transistor and the second terminal of the fifth transistor, and a second terminal electrically coupled to a first terminal of a light emitting diode;

an eighth transistor having a first terminal directly electrically coupled to the first power voltage, and a second terminal directly electrically coupled to the node, wherein a control terminal of the sixth transistor, a control terminal of the seventh transistor and a control terminal of the eighth transistor are electrically coupled to a control signal; and a capacitor having a first terminal electrically coupled to the first power voltage, and a second terminal electrically coupled to the control terminal of the fifth transistor;

wherein the pixel circuit is operated under a reset phase, a compensation phase and a display phase, and the method comprises:

in the reset phase, turning on the first transistor by the first scan signal, turning off the second to eighth transistors by the second scan signal and the control signal, and writing the input voltage into the control terminal of the fifth transistor;

in the compensation phase, turning on the second to fifth transistors by the second scan signal, turning off the first transistor, the sixth transistor, the seventh transistor and the eighth transistor by the first scan signal and the control signal, and inputting the data signal into the fifth transistor via the third transistor; and in the display phase, turning on the fifth to eighth transistors by the control signal, and turning off the first to fourth transistors by the first scan signal and the second scan signal.

* * * * *